US006164155A

United States Patent [19]

Tonissen et al.

[11] Patent Number: 6,164,155

[45] Date of Patent: Dec. 26, 2000

[54] ELECTRONIC TREADLE GEAR DESIGN

[75] Inventors: Eric Tonissen; Christine G. Swansegar, both of North Olmsted, Ohio

[73] Assignee: Honeywell Commerical Vehicle Systems Co., Elyria, Ohio

[21] Appl. No.: 09/208,094

[22] Filed: Nov. 13, 1998

[51] Int. Cl.[7] ..... G05G 1/14

[52] U.S. Cl. ..... 74/514; 74/560

[58] Field of Search ..... 74/514, 513, 560, 74/512; 180/335

[56] References Cited

U.S. PATENT DOCUMENTS 3,398,817 8/1968 Shinga ..... 74/513

5,241,936 9/1993 Byler et al. ..... 74/513 X 5,408,899 4/1995 Stewart ..... 74/514 X 5,819,593 10/1998 Rixon et al. ..... 74/514

*Primary Examiner*—Mary Ann Green

[57] ABSTRACT

A treadle assembly supplies an electrical signal to an electronic controlled engine. The assembly includes a treadle suspended from a vertical wall of the operator compartment so that the components are disposed away from dirt and debris associated with the vehicle compartment. A treadle lever is pivotally mounted and engages a drive gear associated with the potentiometer. Depression of the treadle provides for increased rotation of the drive gear, preferably on the order of a 3:1 output to input ratio. A slot is formed in the actuator base to facilitate assembly of the structure before the springs are brought to a tensioned state.

9 Claims, 2 Drawing Sheets

ELECTRONIC TREADLE GEAR DESIGN

BACKGROUND OF THE INVENTION

This invention pertains to the art of electronic controlled engines, and more particularly to providing an electrical input to such an engine. The invention relates to an electronic treadle or pedal assembly that uses interacting gears to transfer depressed pedal movement from a driver to a potentiometer. This provides an electronic controlled engine with an electrical signal indicative of the need for additional power. However, it will be appreciated that the invention has broader applications and may be advantageously employed in related environments and applications.

Engine manufacturers have developed electronically controlled engines that are responsive to an electrical signal indicative of a driver's request for power. That is, the accelerator pedal or treadle assembly is located in the operator's or driver's compartment and when the treadle is depressed a suitable electronic signal is sent to an electronic control unit operatively associated with the engine. These assemblies typically include a potentiometer that generates an electronic signal corresponding to the amount of depression of the treadle. For example, systems of this type advantageously employ a rotary potentiometer mounted on the treadle so that the entire assembly can be located in the protected environment of the vehicle operator's compartment. An example of a commercially successful unit is shown and described in U.S. Pat. No. 4,528,590, the disclosure of which is commonly owned by the assignee of the present invention, and the details of which are incorporated herein by reference.

When mounted on the floor, the pedal assembly is subject to dirt and debris. Recognition of the fact that the owner's compartment and floor board can quickly accumulate several inches of mud, snow, etc. that could adversely affect the operation of the treadle assembly requires alternative mounting arrangements.

Thus, a need exists for an improved treadle assembly.

SUMMARY OF THE INVENTION

The present invention contemplates a new and improved treadle assembly and method of assembling same which overcomes all of the above-referenced problems and others, and provides a simple, reliable, and protected assembly.

According to the present invention, there is provided a treadle adapted for selective depression by an operator's foot. A treadle lever moves in response to the depression of the treadle and includes gear teeth formed thereon for engaging a drive gear operatively associated with a potentiometer.

According to another aspect of the invention, first and second springs are operatively associated with the treadle lever to urge the lever toward an inactive or idle position.

According to yet another aspect of the invention, a slot is formed in an actuator base allowing the treadle lever to be rotated therethrough during assembly. This allows the torsion springs to be positioned in place without having to preload or tension the springs.

A principal advantage of the invention is a compact, protected assembly that can be suspension mounted from a generally vertical wall of the operator's compartment.

Another advantage of the invention resides in the minimal number of parts or components of the assembly which provides decreased maintenance costs.

Yet another advantage of the invention is found in the ease with which the components may be assembled and subsequent reliable operation of the treadle assembly.

Still other advantages and benefits of the invention will become apparent to those skilled in the art upon a reading and understanding of the following detailed description.

BRIEF DESCRIPTION OF THE DRAWINGS

The invention may take physical form in certain parts and arrangements of parts, preferred embodiments of which are described in detail in this specification and illustrated in the accompanying drawings. The drawings include.

DETAILED DESCRIPTION OF THE PREFERRED EMBODIMENT

Figure 1:
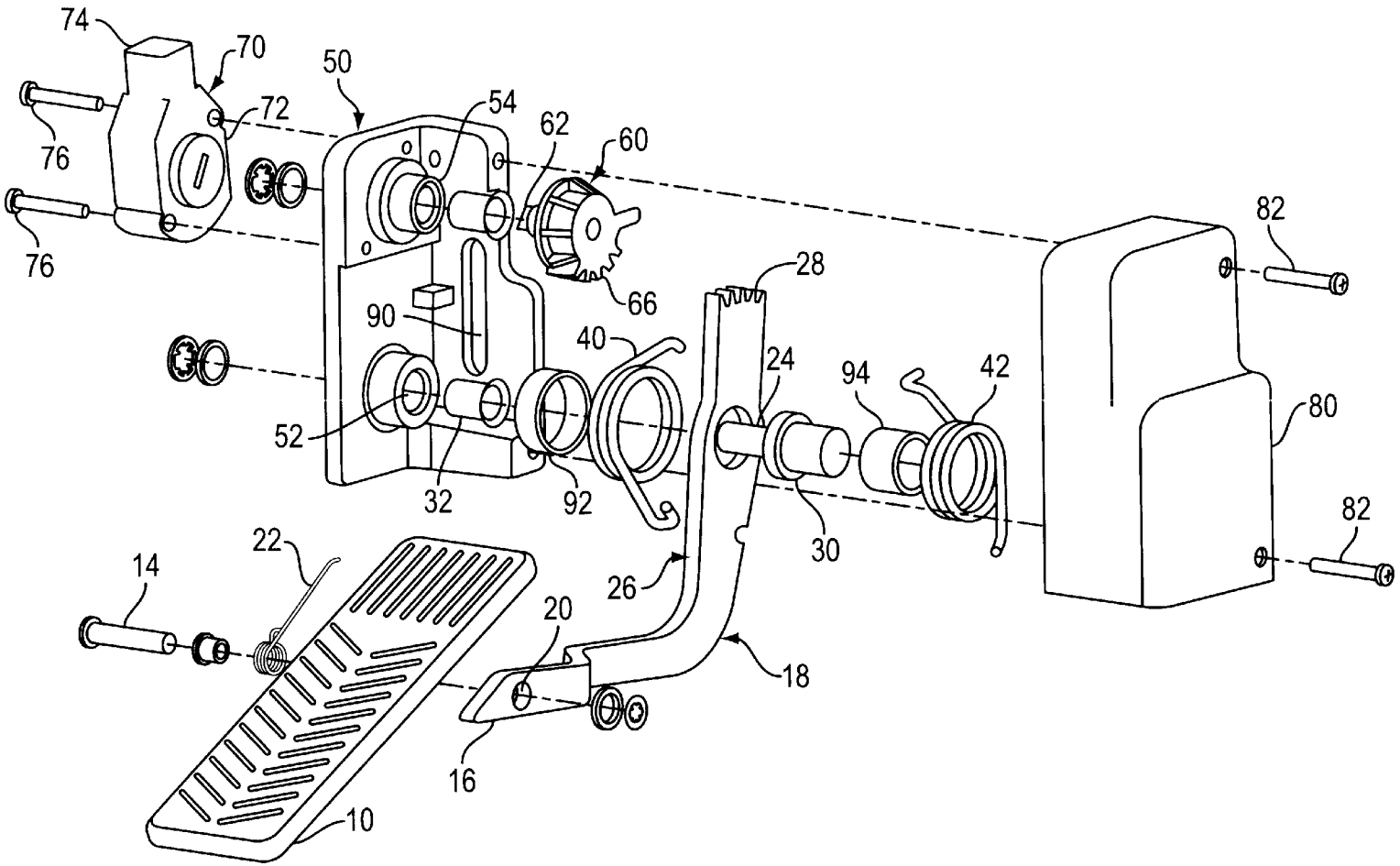
FIG. 1 which is an exploded view of the individual components of a preferred treadle assembly in accordance with the present invention; and, FIG. 2 is a perspective view of the assembled treadle with a cover removed for ease of illustration.

Referring now to the drawings wherein the showings are for the purposes of illustrating the preferred embodiment of the invention only and not for limiting the invention, the Figures show a treadle assembly A such as used in a heavy duty vehicle or truck having an electronically controlled engine. More specifically, the treadle assembly A includes a pedal or treadle 10 having a non-slip material such as plastic, rubber, or the like thereon. The treadle is pivotally mounted via pin 14 adjacent a first end 16 of a treadle lever 18. Preferably, the lever has a generally L-shape with an opening 20 formed in the first end to receive the pin 14. A spring 22 encompasses the pin 14 and has a first end engaging the lever, and a second end engaging the treadle. This spring imposes a biasing force that orients the treadle to a desired angular position. It will be recognized that alternative mounting arrangements between the treadle and lever, or a different biasing spring, could be used without departing from the scope and intent of the invention.

The treadle lever 18 is preferably a one-piece construction. It includes an enlarged opening 24 disposed in a second arm portion 26 thereof. Moreover, the lever includes gear teeth 28 integrally formed at the terminal end of the second arm portion for reasons which will become more apparent below. The opening 24 is dimensioned to receive a ferrule 30, one end of which is received in a sleeve bearing 32, which allows the treadle lever to pivot or rotate relative to the ferrule. In addition, first and second torsion springs 40, 42 are received on opposite ends of the ferrule, and likewise on opposite sides of the treadle lever. Each torsion spring has one end engaging the lever 18 and a second end engaging an actuator base 50, the details of which will be described further below.

In the absence of any force imposed on the treadle, the lever 18 is urged by the springs 40, 42 toward a first or idle position. The first end of the ferrule is received in a mounting recess 52 in the actuator base. This defines the rotational or pivoting axis about which the lever moves. Thus, depression of the treadle rotates the first end 16 of the lever about the ferrule 30. This provides for movement of the gear teeth 28 at the second end of the lever along a generally arcuate path.

A drive gear 60 is rotatably received in a second mounting region 54 defined as a through opening through the actuator base. The drive gear has a small diameter first end 62 that extends through a sleeve bearing 64 received in the opening 54. An enlarged diameter portion of the drive gear includes a set of teeth 66 defined along a peripheral region. As shown in FIG. 1, the teeth 66 extend over a limited peripheral portion of the drive gear in facing, meshing relation with the lever teeth 28. The spur gear or gear teeth 28 of the lever cooperate with the pinion gear 66 defined on the drive gear to provide approximately a 3:1 gear ratio. This is a preferred ratio that matches a desired sensitivity of a potentiometer 70 and ergonomics for a driver. That is, only eighteen degrees of input from the treadle results in fifty four degree rotation of the potentiometer 70. The potentiometer has a drive recess 72 that receives the small diameter end 62 of the drive gear. The rotation of the potentiometer a selected amount outputs an electrical signal through port 74 in response to depression of the treadle. The potentiometer is preferably secured to an external face of the actuator base via a pair of fasteners 76, although other fastening arrangements may also be used without departing from the scope and intent of the present invention. In addition, a cover member 80 cooperates with the actuator base 50 to form a housing, with the cover member and actuator base secured together by one or more fasteners 82. The housing has a primary opening on the bottom portion thereof (not shown) through which the lever 18 extends, and the housing shields dirt and debris from interfering with operation of the components of the treadle assembly.

To facilitate assembly of the electronic treadle, a secondary opening in the form of an elongated slot 90 is provided in a wall of the actuator base. The elongated slot is adapted to receive the second arm portion 26 of the treadle lever therethrough as it pivots relative to the actuator base about the axis of the opening 24. During assembly, sleeve bearing 32 is received in recess 52 through the first spring 40. A first spacer, such as nylon spacer 92, prevents the spring from wearing on the boss 52 of the actuator base. The spacer can rotate relative to the boss so that the spring does not wear the boss. The larger diameter portion of the ferrule then receives a second spacer 94 and the second torsion spring 42 in a like manner Since first ends of each of torsion springs 40, 42 are secured to the lever, the lever may be pivoted or rotated so that the outermost end of the first arm 26 extends through the opening 90. This allows the springs to be secured in place in a relaxed or untensioned state. Thereafter, the treadle lever 18 is rotated into the cavity or the actuator base, i.e., the second arm portion 26 is pivoted out of the slot 90 and into the cavity defined by the actuator base and cover 80. This places a preload on the treadle lever that urges the treadle toward an idle position. The drive gear 60 is positioned in place so that the teeth of the pinion and spur gears 28, 66 are engaged. The cover 80 is then secured in place via cover fasteners 82.

Figure 2:
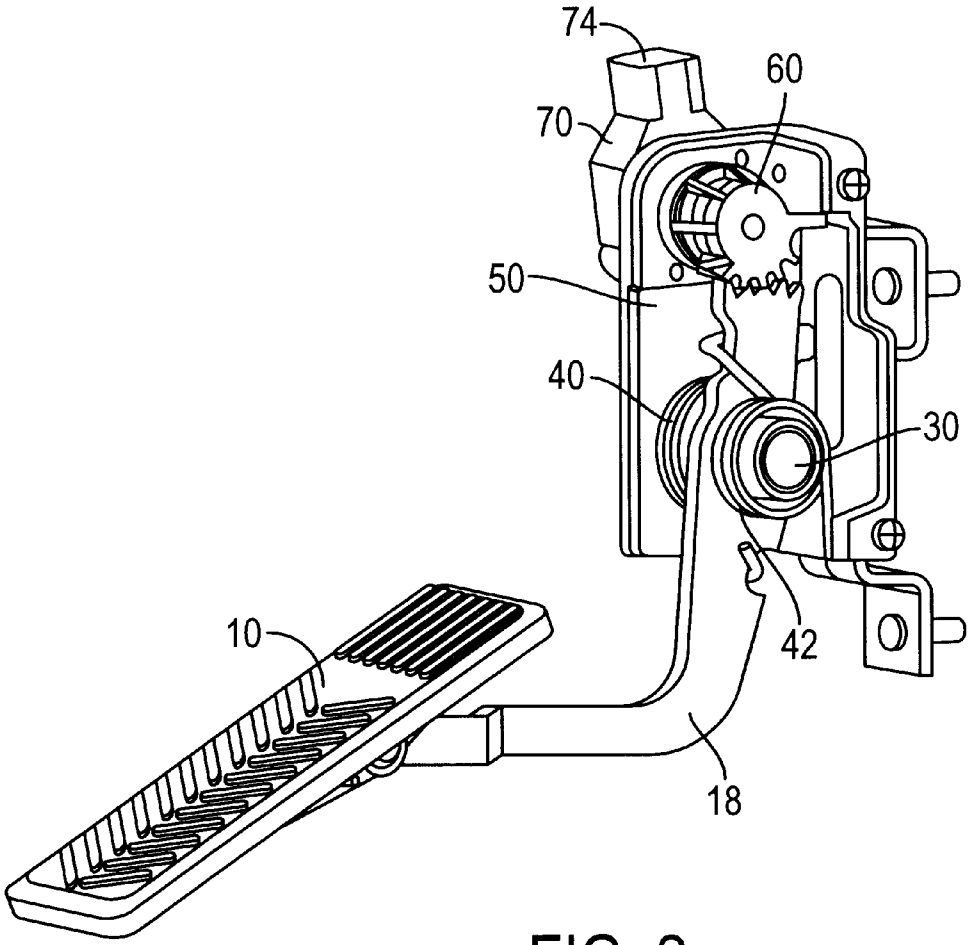

FIG. 2 illustrates the assembled treadle, lever and potentiometer. One variation is the location of the second torsion spring. Here, it is located about the drive gear but the embodiment of FIG. 1 is preferred. In substantially all other respects, the embodiment of FIG. 2 is structurally and functionally the same as described above.

In operation, as the driver depresses the treadle, the treadle lever will rotate and cause the drive shaft gear to rotate. The drive shaft gear rotates the drive slot of the potentiometer and sends a suitable electrical signal to the electronic controlled engine (not shown). The drive shaft gear, potentiometer, and treadle lever gear are all secured to the actuator base to ensure that they properly interact with each other. The torsion spring pair are mounted to the treadle lever to provide a pair of energy sources required to urge the treadle toward the idle position. A gear ratio between the teeth 28, 66 provides for the desired sensitivity of the assembly.

The invention has been described with reference to the preferred embodiment. Obviously, modifications and alterations will occur to others upon a reading and understanding of this specification. It is intended to include these modifications and alterations insofar as they come within the scope of the appended claims or the equivalents thereof.

Having thus described the invention, it is claimed:

1. A treadle assembly for supplying an electrical signal to an electronic controlled engine comprising:

a treadle adapted for selective depression by an operator's foot;

a pivot member;

a lever, movable about the pivot member through a plane, operatively engaging the treadle and having teeth formed in a portion thereof, said lever including two opposing exterior surfaces that are substantially parallel to said plane;

a drive gear mounted for engagement with the lever teeth;

a first spring, located proximate to one of said two opposing exterior surfaces of the lever, for urging the lever toward a first position;

a second spring, located proximate to the other of said two opposing exterior surfaces of the lever, for urging the lever toward the first position, such that the lever is located between the first spring and the second spring; and a potentiometer operatively associated with the drive gear for outputting an electrical signal in response to the degree of movement of the drive gear.

2. The treadle assembly of claim 1 wherein said first position is an idle position.

3. The treadle assembly of claim 1 wherein the drive gear and the lever have approximately a 3:1 gear ratio.

4. The treadle assembly of claim 1 wherein the treadle is pivotally mounted adjacent one end of the lever.

5. A treadle assembly for supplying an electrical signal to an electronic controlled engine comprising:

a treadle adapted for selective depression by an operator's foot;

a pivot member;

a lever, movable about the pivot member through a plane, operatively engaging the treadle and having teeth formed in a portion thereof, said lever including two opposing exterior surfaces that are substantially parallel to said plane;

a drive gear mounted for engagement with the lever teeth;

a potentiometer operatively associated with the drive gear for outputting an electrical signal in response to the degree of movement of the drive gear; and a stationary housing having a primary opening through which the lever extends such that the housing protectively encloses the pivot member, the drive gear, and a first portion of the lever, while a second portion of the lever and the treadle are outside of the housing.

6. The treadle assembly of claim 5 wherein the drive gear and the lever have approximately a 3:1 gear ratio.

7. The treadle assembly of claim 5, further comprising:

a first spring, located proximate to one of said two opposing exterior surfaces of the lever, for urging the lever toward a first position; and a second spring, located proximate to the other of said two opposing exterior surfaces of the lever, for urging the lever toward the first position, such that the lever is located between the first spring and the second spring.

8. The treadle assembly of claim 5 wherein the housing includes a secondary opening dimensioned to receive a portion of the lever therethrough.

9. The treadle assembly of claim 8 wherein the secondary opening is dimensioned to receive the lever therethrough during assembly so that first and second springs operatively associated with the lever can be assembled in a non-tensioned state.

* * * * *